US005480150A

United States Patent [19]

Weyand

[11] Patent Number: 5,480,150

[45] Date of Patent: Jan. 2, 1996

[54] SYSTEM FOR GENERATING RANDOM OUTCOMES USING DISCS

[76] Inventor: Rudi Weyand, 16776 Bernardo Center Dr., Suite 110B, San Diego, Calif. 92128

[21] Appl. No.: 349,549

[22] Filed: Dec. 5, 1994

[51] Int. Cl.[6] ..... A63F 3/00; A63F 9/02

[52] U.S. Cl. ..... 273/138 R; 273/244; 273/93 R; 273/424; 273/393

[58] Field of Search ..... 273/243, 299, 273/144 R, 144 A, 144 B, 148 R, 424, 294, 138 R, 139

[56] References Cited

U.S. PATENT DOCUMENTS

| | | | |
|---|---|---|---|
| 2,026,682 | 1/1936 | Jeffries | 273/144 R |
| 2,792,227 | 5/1957 | Auerbach | 273/249 |
| 4,087,093 | 5/1978 | Imbert | 273/243 |
| 4,128,246 | 12/1978 | Hicks et al. | 273/243 |
| 4,325,556 | 4/1982 | DeCanto et al. | 273/424 |
| 5,340,113 | 8/1994 | Respicio | 273/249 |

OTHER PUBLICATIONS

Math Caps game by S.E.I., Inc., 1994.

*Primary Examiner*—Benjamin H. Layno
*Attorney, Agent, or Firm*—Brown, Martin, Haller & McClain

[57] ABSTRACT

Discs bearing markings or other indicators that differentiate them from each other are used to randomly select one of a number of possible outcomes. The discs may thus be used to introduce an element of chance in games. Each disc has two sides, one of which is marked with a number. The discs are grouped into sets. The number marked on each disc in a set is the same as that of all other discs in that set, but is different from that of all discs in other sets. To use the discs to randomly select an outcome, a person stacks all the discs on top of one another. The person then upsets the stack by tossing a heavier or larger disc at the stack. After the stack topples, the person counts the number of discs in each set that have come to rest in an orientation either with the number-side facing upwardly or, alternatively, with the number-side facing downwardly.

6 Claims, 2 Drawing Sheets

SYSTEM FOR GENERATING RANDOM OUTCOMES USING DISCS

BACKGROUND OF THE INVENTION

Random outcome generators may be used to introduce an element of chance in board games and other games played for entertainment. Dice are probably the most common random outcome generators used for this purpose, although wheels and other devices are also used. A die is a polyhedron that has a number or other indicator imprinted, engraved or otherwise disposed on each of its sides. Each number or indicator is different. When the die is rolled on a flat surface, it comes to rest on one of its sides with another one of its sides facing upward. The number on the upwardly facing side determines the outcome of the roll and is essentially random. Although the most commonly used dice have six sides (hexahedrons or cubes), dice having as many as ten sides (decahedrons), twelve sides (dodecahedrons) or even twenty sides (icosahedrons) are also known.

Dice having a large number of sides are inconvenient to use. The larger the number of sides, the smaller the area of each in relation to the overall size of the die. It is difficult to imprint or engrave numbers or other indicia on very small areas. Furthermore, it is difficult to discern very small indicia. Moreover, the area of the surface on which the die rests must be flat to discern which side is facing upward; the smaller the area of the sides, the flatter the surface must be. Turf, concrete, asphalt, tile and similar rough surfaces are unsuitable for rolling ten or twentysided dice of typical size.

Coins have been used to randomly select one of two possible outcomes. Coins are discs having an obverse side and a reverse side, commonly known as a "head" and a "tail," respectively. The head and tail bear different indicia. (The obverse or "head" sides of many coins bear a bust or likeness of a person's head, while the reverse side does not.) When the coin is tossed on a relatively flat surface, it lands with either its obverse or reverse side facing upward. Coins are advantageous because a person can toss a coin of typical size on nearly any surface without experiencing difficulty discerning which side is facing upward. Nevertheless, the use of a coin is limited to generating one of two possible numbers or outcomes. Coins are therefore not used to generate random outcomes in board games and the like.

A game known as "pog" is played using milk-bottle caps or similarly sized discs. The discs, also known as pogs, are stacked on top of one another. The obverse and reverse sides of each pog bear different indicia, and all the pogs are stacked with their obverse sides facing upward. A player tosses another pog, which is sometimes called a "slammer" and which is typically heavier or larger, at the stacked pogs. The stack or a portion of it topples as a result of the impact with the slammer. The player gathers and keeps any pogs that have flipped over, i.e., those that have landed on the ground with their reverse sides up. The remaining pogs are re-stacked, and the player's opponent then takes a turn in the same manner, keeping any pogs that have flipped over. When all pogs have been flipped over, the player with the most pogs wins the game.

SUMMARY OF THE INVENTION

The present invention comprises a plurality of sets of discs bearing indicia that differentiate them from each other as described below, and a method for using the discs to randomly select one of a predetermined number of outcomes. The discs may thus be used to introduce an element of chance in games.

Each disc is a substantially flat piece of a suitable material having exactly two sides. The perimeter of the disc may be circular, square, hexagonal, octagonal or any other shape, including irregular shapes. One side of each disc has indicia formed in any suitable manner, such as printing, embossing, molding and the like. The indicia of each disc in a set are the same as that of all other discs in that set, but are different from that of all discs in other sets. Although any indicia are suitable, in an exemplary embodiment, the indicia comprise arabic numerals or other symbols that a person can readily associate with a numeric value. The other (non-indicia) sides of the discs may be solid colors, patterns or any other designs and may be uniform among all discs or vary among discs, so long as all of the non-indicia sides can be readily distinguished from the indicia sides.

To use the discs to randomly select an outcome, a person stacks all the discs on top of one another. The discs may be stacked in a uniform orientation, i.e., with the indicia sides of all discs facing either upwardly or downwardly, in a predetermined non-uniform orientation, or in random orientations, i.e., randomly or without regard to orientation. The person then upsets the stack. In an exemplary embodiment, the stack is upset by tossing another, preferably heavier or larger, disc at the stack. After the stack topples or is otherwise upset, the person counts the number of discs in each set that have come to rest in a predetermined orientation. In other words, the person either counts the number of discs in each set that have come to rest with their indicia sides facing upwardly or counts the number of discs in each set that have come to rest with their indicia sides facing downwardly.

The person uses these set counts and a predetermined relationship to determine the outcome. A predetermined relationship for a board game, for example, may include a correspondence between each different combination of set counts and the number of spaces to move a playing piece on the board.

The sets of discs may, in an exemplary embodiment, be used to generate random numbers as an intermediate step prior to determining an outcome. The predetermined relationship may include a correspondence between each of the indicia and a numeric value. A person may multiply the count corresponding to each set by the numeric value corresponding to its indicia and sum the results together to generate a numeric result. It should be noted that counting the number of discs in a set that have come to rest in a predetermined orientation and multiplying that count by a numeric value corresponding to their indicia is equivalent to summing the numeric values corresponding to the indicia of those discs. As used herein, counting discs or forming a count of discs refers only to determining the number of such discs, a step that is inherently performed when a person sums or adds together a plurality of equal numeric values. The predetermined relationship also includes a correspondence between the possible numeric results and different outcomes. For example, a predetermined relationship for a board game may include a correspondence between the numeric results and the number of spaces to move a playing piece on the board.

Although the word "random" is used herein, the degree of randomness of the outcome depends upon several factors. The relative numbers of discs in the sets, the manner in which the discs are stacked and the manner in which they are toppled will all affect the probability distribution of the outcomes. By altering these factors, persons of skill in the art can produce a distribution in which the probability of each outcome is approximately the same. Such a distribution would allow the present invention to be used to emulate the operation of dice. Nevertheless, in many games it is desirable to weight the probability of some outcomes more heavily than others. Persons of skill in the art will readily be capable of producing a desired probability distribution.

The foregoing, together with other features and advantages of the present invention, will become more apparent when referring to the following specification, claims, and accompanying drawings.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF A PREFERRED EMBODIMENT

Figure 1A:
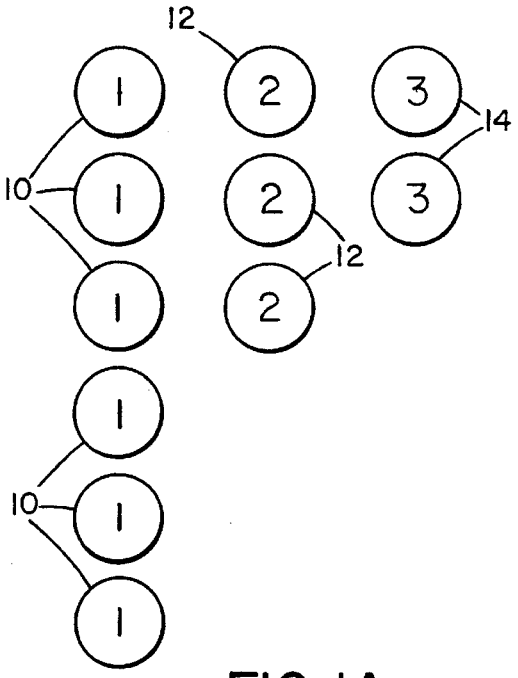
FIG. 1A is a top plan view of the discs.
Figure 1B:
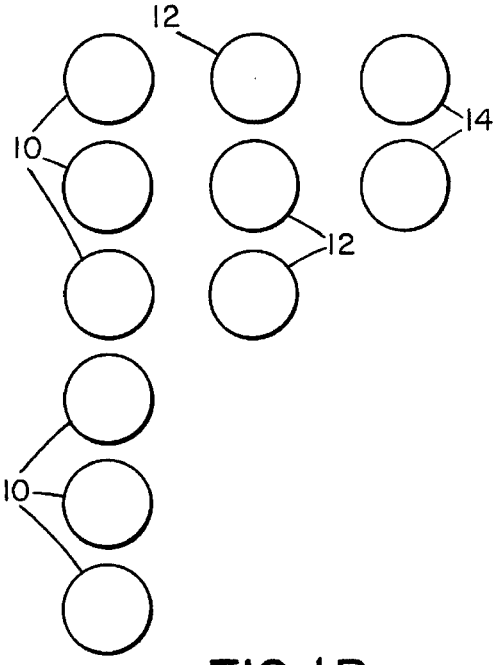
FIG. 1B is a bottom plan view of the discs.

As illustrated in FIG. 1 A–B, six discs 10 define a first set of discs, three discs 12 define a second set of discs, and two discs 14 define a third set of discs. The discs may be made of any suitable material, such as cardboard. As illustrated in FIG. 1 A, the obverse sides or indicia sides of discs 10, 12 and 14 are labeled respectively with the arabic numerals "1," "2" and "3." The numerals allow a person to readily distinguish the discs of each set from the discs of the other sets. Each set thus consists of discs having the same indicia as all other discs in the set but different from that of discs in the other sets. Although in the illustrated embodiment discs 10–12 are labeled with arabic numerals, any indicia that allow a person to distinguish the discs of a set from those of the other sets are suitable. For example, the discs may have different colors, illustrations, patterns, or abstract designs. As illustrated in FIG. 1 B, the reverse sides of discs 10–12 are blank and thus not labeled with any of the numerals or indicia that appear on the obverse sides of discs 10–12. Although in the illustrated embodiment, the reverse sides of discs 10–12 are blank or a uniform color, they may bear any designs or markings that are distinguishable from the indicia on the first sides of discs 10–12.

Figure 2A:
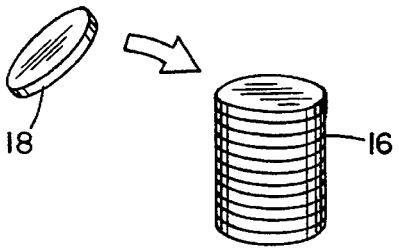
FIG. 2A is a perspective view of the stacked discs and an additional disc being tossed at them.
Figure 2B:
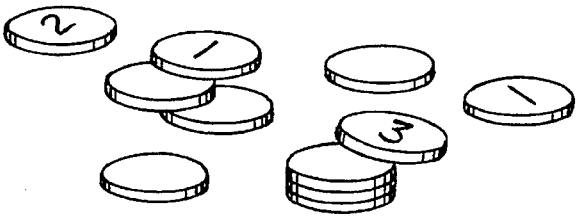
FIG. 2B is a perspective view of the toppled stack of discs.

As illustrated in FIG. 2A, discs 10, 12 and 14 are stacked on top of each other in random order to form a stack 16. Discs 10–12 are stacked with their obverse or indicia sides facing downward. Another disc 18, which is preferably made of a heavier material than discs 10–12, is tossed at or dropped onto stack 16. The impact between disc 18 and stack 16 topples stack 16 and scatters discs 10–12. The scattered discs 10–12 come to rest with either their indicia sides or non-indicia sides facing upward, as illustrated in FIG. 2B. The number of discs 10 resting with their indicia sides facing upward are counted, as are the number of discs 12 and the number of discs 14 resting with their indicia sides facing upwardly.

The following chart may be used to convert the counts of discs 10–12 resting with their indicia sides facing upwardly into an outcome. The chart relates the possible counts of upwardly facing discs to possible outcomes in a simulated game of baseball. This simulated baseball game is intended only as an illustration of a game in which a random outcome is required. Other games in which random outcomes are generated include MONOPOLY®, PARCHEESI®, TWISTER® and the like. In view of the teachings herein, all such games in which the present invention may be used will be readily apparent to persons of skill in the art.

| | |
|---|---|
| 1 = Ball | 10 = Ball |
| 2 = Foul Ball | 11 = Ground Out |
| 3 = Single | 12 = Steal / Ball |
| 4 = Pop Out | 13 = Triple |
| 5 = Squeeze Play / Ball | 14 = Ball |
| 6 = Single | 15 = Pop Out / Bunt |
| 7 = Double Play / Out | 16 = Home Run |
| 8 = Foul Ball | 17 = Ball |
| 9 = Double | 18 = Foul Ball |

To use the above chart, each count is multiplied by the number on the discs of the set corresponding to that count. The results are then summed and the sum, which is a number between zero and 18, inclusive, is located on the chart. (The probability of a sum of zero is so small that its corresponding outcome is not shown on the chart.) The chart shows the outcome corresponding to each possible sum. The number on the discs in each set thus represents the weight of the discs in that set. The number of discs 10 is greater than the number of discs 12, which in turn is greater than the number of discs 14. The relative number of discs in the sets affects the probability distribution of the outcomes. In the illustrated embodiment, the relative numbers of discs in each set are selected to approximate the probabilities of various event that occur in a game of baseball.

As described above, the chart illustrates the relationship between the sum of the weighted counts and the possible outcomes. Such a relationship is preferred because it relates a single numeric value to an outcome, and a person can readily determine that numeric value by multiplying each count by its weight and summing the results (or, stated equivalently, by summing the numbers on all upwardly facing discs). Nevertheless, in other embodiments, indicia that is non-numeric or otherwise not readily associable with a numeric value may be used. In such embodiments, a relationship (not shown) exhaustively listing the possible combinations of counts and the possible outcomes may be used. In such embodiments, the weights may not be readily perceivable to a user but exist inherently in the manner in which the combinations are related to the outcomes.

Figure 3A:
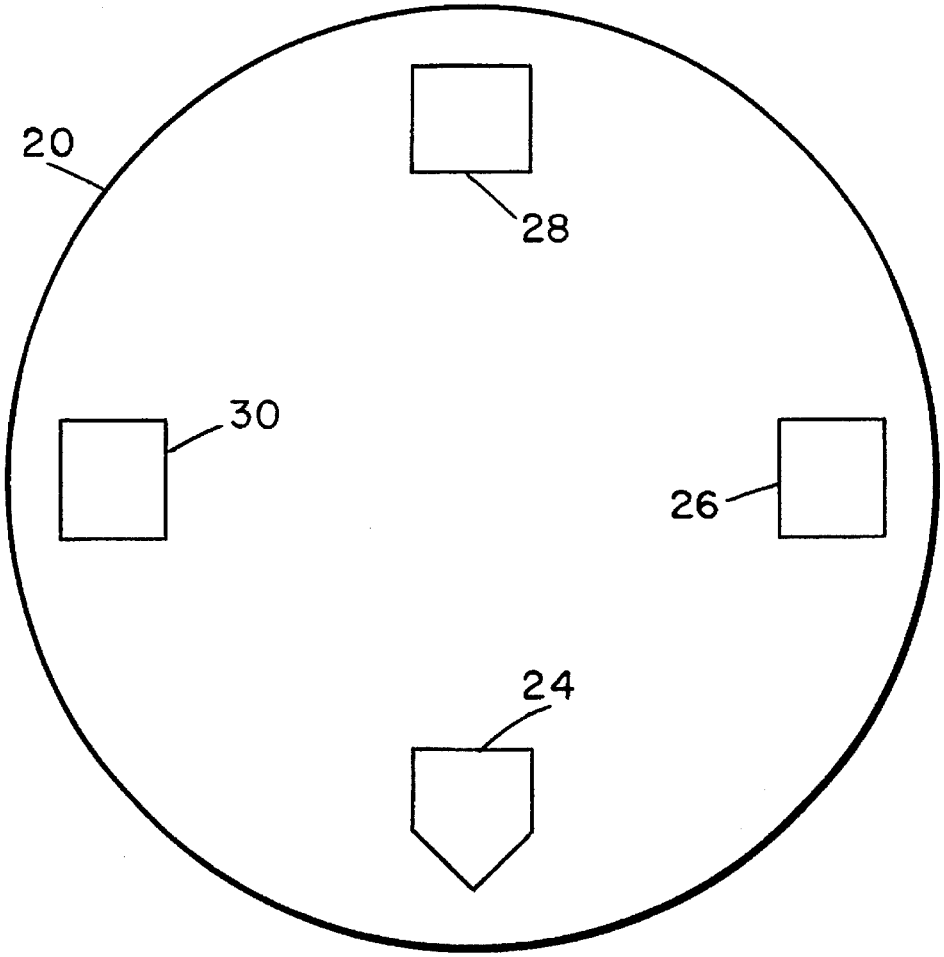
FIG. 3A is a top plan view of a game board for playing a simulated game of baseball.
Figure 3B:
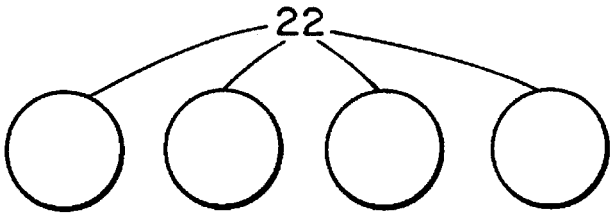
FIG. 3B is a top plan view of playing pieces for the game board.

As illustrated in FIG. 3A, in addition to the eleven discs 10–12, a game board 20 and, as illustrated in FIG. 3B, four playing pieces 22 are used to play the baseball board game. Game board 20 has bases 24, 26, 28 and 30, which are locations on the board appropriately arranged generally in a baseball diamond shape and marked to represent the respective locations of home plate, first base, second base and third base.

One of the discs is flipped in the manner of a conventional coin toss to determine which of two players is at bat first. The player at bat stacks discs 10–12 and tosses or pitches disc 18 at stack 16, as described above. The sum is calculated as described above, and the outcome is determined. In general, the rules of the game are those of conventional baseball. The positions of the players on the bases are marked by placing a player piece 22 on the appropriate one of bases 26–30. Player pieces 22 are advanced from home plate 24 to first base 26 to second base 28 to third base 30 and back to home plate 24 in the conventional manner. Runs and outs are accumulated in the conventional manner, as described in further detail below with respect to the chart. When the player at bat accumulates three outs, the other player takes a turn at bat. The preferred nine innings may be played in this manner.

In accordance with the chart, if the sum equals 10, 14 or 17, the outcome is a "ball." If the sum equals two, eight or 18, the outcome is a "foul ball." If the sum equals three or six, the outcome is a "single." If a player piece 22 is on first base 24, it is advanced to second base 28. If a player piece is on second base 28, it is advanced to third base if a player piece 22 is advanced to second base 28. If a player piece 22 is on third base 30, it is advanced to home plate 24 if a player piece 22 is advanced to third base. In addition, a player piece is placed on first base 26. If the sum equals four, the outcome is a "pop out." If the sum equals five and if no player piece 22 is on third base 30, the outcome is a "ball." If the sum equals five and a player piece 22 is on third base 30, the outcome is a "squeeze play"; the player piece 22 on third base 30 is advanced to home plate 24. If the sum equals seven, the outcome is a "double play" if a player piece 22 is on first base 26 or an "out" if no player piece 22 is on first base 26. If the sum equals nine, the outcome is a "double." Player pieces are advanced two bases, scoring runs if advanced to home plate 24. A player piece is placed on second base 28. If the sum equals 11, the outcome is a "ground out." If the sum equals 12, the outcome is a "ball, but if there is a player piece on first base 26 equals 13, the outcome is a "triple." Any player pieces 22 on bases 26, 28 or 30 are advanced to home plate 24 and score runs. A player piece is placed on third base 30. If the sum equals 15, the outcome is a "pop out" or "bunt" and counts as an "out." A player piece 22 on first base 26 is advanced to second base 28. A player piece on second base 28 is advanced to third base 30 if no player piece 22 is on third base 30. If the sum equals 16, the outcome is a "home run." All player pieces on bases 26–30 are advanced home, scoring runs. Another run is scored for the batter.

It will be evident that there are additional embodiments and applications which are not disclosed in the detailed description but which clearly fall within the scope and spirit of the present invention. The specification is, therefore, not intended to be limiting, and the scope of the invention is to be limited only by the following claims.

What is claimed is:

1. A method for using a plurality of sets of discs to randomly select an outcome from a predetermined set of outcomes, each set consisting of at least one disc, each disc having an indicia side and a non-indicia side, said indicia side of each said disc having indicia the same as said indicia of said indicia side of every other said disc in said set and different from said indicia of said indicia side of said discs in every other said set, the method comprising the steps of:

stacking said plurality of discs;

impacting said stack with a disc;

forming a plurality of counts, each count corresponding to the number of said discs in one said set resting in a predetermined orientation; and determining said outcome in response to a predetermined relationship between said plurality of counts and said predetermined set of outcomes.

2. The method claimed in claim 1, wherein:

said predetermined relationship comprises a correspondence between each of said indicia and a numeric value, and said predetermined set of outcomes is a set of numeric values; and said step of determining said outcome comprises the steps of:

multiplying each count in said plurality of counts by said numeric value corresponding to said indicia of said discs corresponding to said count; and summing said plurality of counts to form a numeric value in set of numeric values.

3. The method claimed in claim 1, wherein said predetermined set of outcomes comprises selecting a position on a game board having a plurality of positions.

4. The method claimed in claim 3, wherein:

a playing piece is positionable on said game board at each position; and said method further comprises the step of moving said playing piece from one position to another in response to said outcome.

5. A system for randomly selecting an outcome from a predetermined set of outcomes, comprising:

a plurality of sets of discs, each set consisting of at least one disc, each disc in said set having an indicia side and a non-indicia side, said indicia side of each said disc in a set having the same indicia as said indicia side of every other said disc in said set and different from said indicia of said indicia side of said discs in every other said set.

a disc having a cross-sectional thickness greater than that of each disc in said plurality of sets of discs;

a game board having a plurality of positions; and at least one playing piece, said playing piece disposable at said positions, said predetermined set of outcomes includes changing said position at which a playing piece is disposed.

6. The method claimed in claim 1, wherein said predetermined set of outcomes includes changing a position at which a playing piece is disposed on a game board.

* * * * *